US009465347B2

(12) United States Patent
Hagiwara

(10) Patent No.: US 9,465,347 B2
(45) Date of Patent: Oct. 11, 2016

(54) TRANSPORT DEVICE AND IMAGE FORMING APPARATUS THAT CAN ALIGN A TRANSFER BELT

(71) Applicant: FUJI XEROX CO., LTD., Minato-ku, Tokyo (JP)

(72) Inventor: Kazuyoshi Hagiwara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/475,688

(22) Filed: Sep. 3, 2014

(65) Prior Publication Data

US 2015/0277330 A1 Oct. 1, 2015

(30) Foreign Application Priority Data

Mar. 28, 2014 (JP) ..... 2014-068871

(51) Int. Cl.
*G03G 15/00* (2006.01)
*G03G 15/16* (2006.01)

(52) U.S. Cl.
CPC ..... *G03G 15/755* (2013.01); *G03G 15/161* (2013.01); *G03G 15/1615* (2013.01); *G03G 15/6529* (2013.01); *G03G 2215/00143* (2013.01); *G03G 2215/00156* (2013.01)

(58) Field of Classification Search
CPC ..... G03G 15/755; G03G 2215/00143; G03G 2215/00156
See application file for complete search history.

(56) References Cited

U.S. PATENT DOCUMENTS

| | | | | |
|---|---|---|---|---|
| 5,896,979 | A * | 4/1999 | Hokari | G03G 15/755 198/806 |
| 7,873,311 | B2 * | 1/2011 | Hara | G03G 15/161 399/165 |
| 8,160,482 | B2 * | 4/2012 | Nakura | 399/302 |
| 8,606,153 | B2 * | 12/2013 | Hiratsuka et al. | 399/302 |
| 9,029,054 | B2 * | 5/2015 | Okuda | G03G 5/0605 430/65 |
| 2007/0147894 | A1 | 6/2007 | Yokota | |
| 2013/0016996 | A1 * | 1/2013 | Yuasa | 399/121 |
| 2013/0064579 | A1 * | 3/2013 | Takahashi | G03G 15/0131 399/301 |

FOREIGN PATENT DOCUMENTS

| | | |
|---|---|---|
| JP | 2004-359438 A | 12/2004 |
| JP | 2007-079399 A | 3/2007 |
| JP | 2007-148113 A | 6/2007 |

* cited by examiner

*Primary Examiner* — Justin Olamit
(74) *Attorney, Agent, or Firm* — Sughrue Mion, PLLC

(57) ABSTRACT

A transport device includes a driving roller that drives an endless belt so that the belt rotates, a transfer roller that presses the belt from an inner side of the belt toward an image carrier, which carries a toner image, and transfers the toner image onto the belt, a first stretching roller that stretches the belt, a second stretching roller that stretches the belt, wherein the second stretching roller is disposed at a position between the driving roller and the first stretching roller, and wherein the second stretching roller is disposed on a side on which the transfer roller is in contact with the belt, and an adjusting mechanism that adjusts a direction of a rotary shaft of the second stretching roller.

12 Claims, 7 Drawing Sheets

TRANSPORT DEVICE AND IMAGE FORMING APPARATUS THAT CAN ALIGN A TRANSFER BELT

CROSS-REFERENCE TO RELATED APPLICATIONS

This application is based on and claims priority under 35 USC 119 from Japanese Patent Application No. 2014-068871 filed Mar. 28, 2014.

BACKGROUND

Technical Field

The present invention relates to a transport device and an image forming apparatus.

SUMMARY

According to an aspect of the invention, there is provided a transport device including a driving roller that drives an endless belt so that the belt rotates, a transfer roller that presses the belt from an inner side of the belt toward an image carrier, which carries a toner image, and transfers the toner image onto the belt, a first stretching roller that stretches the belt, a second stretching roller that stretches the belt the driving roller and the first stretching roller and on a side on which the transfer roller is in contact with the belt, and an adjusting mechanism that adjusts a direction of a rotary shaft of the second stretching roller.

BRIEF DESCRIPTION OF THE DRAWINGS

Exemplary embodiments of the present invention will be described in detail based on the following figures, wherein.

DETAILED DESCRIPTION

Figure 1:
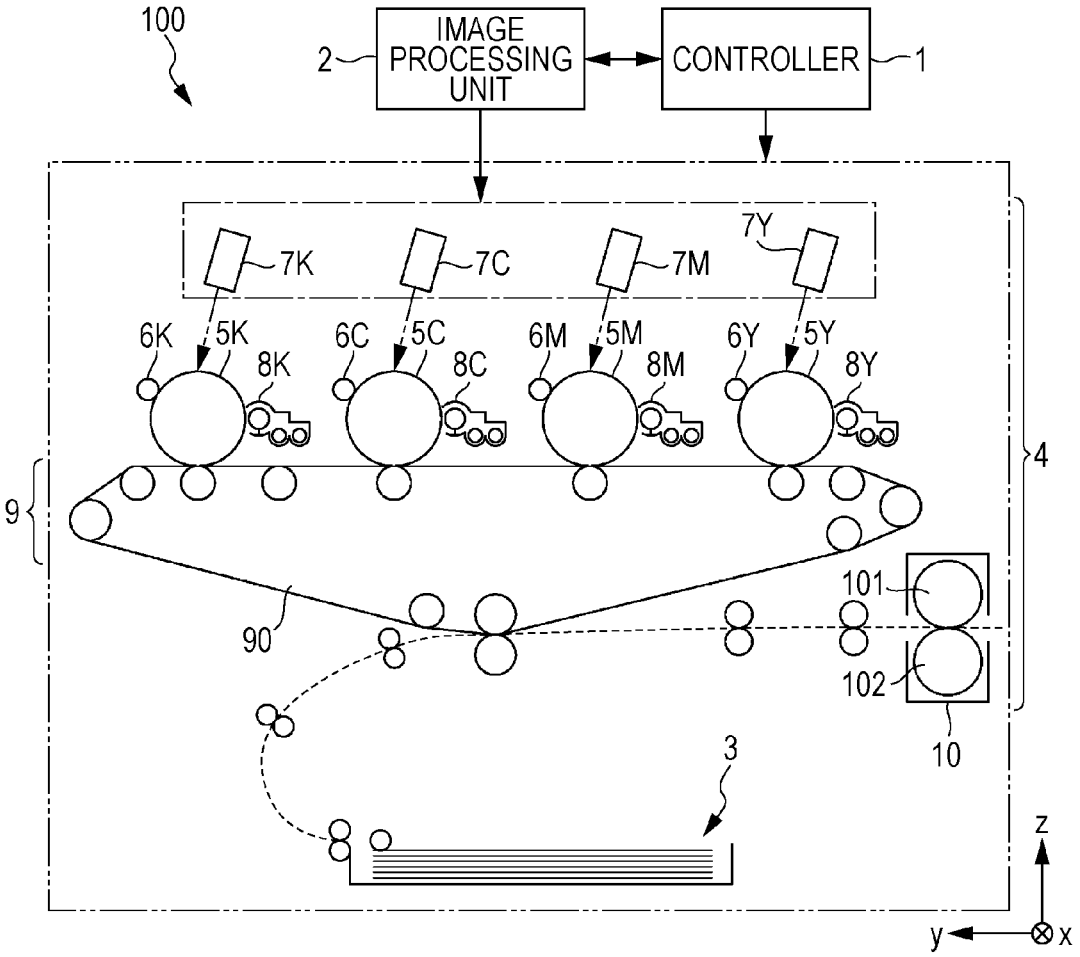
FIG. 1 is a diagram illustrating a schematic internal configuration of an image forming apparatus.

FIG. 1 is a diagram illustrating a schematic internal configuration of an image forming apparatus 100 according to an exemplary embodiment of the present invention. The image forming apparatus 100 employs an electrophotographic system and forms an image on a recording medium. The image forming apparatus 100 includes a controller 1, an image processing unit 2, a sheet feed unit 3, and an image forming unit 4.

The controller 1 includes a central processing unit (CPU), a read only memory (ROM), and a random access memory (RAM). The controller 1 controls each of the units of the image forming apparatus 100 by causing the CPU to execute a program that is stored in the ROM by loading the program into the RAM. The image processing unit 2 performs various image processing on image data that has been input to the image processing unit 2 and then outputs the image data. Recording media are accommodated in the sheet feed unit 3. The sheet feed unit 3 sends out the recording media, which are accommodated in the sheet feed unit 3, one by one. The recording media, which have been sent out from the sheet feed unit 3, are transported to the image forming unit 4.

The image forming unit 4 includes photoconductor drums 5 (5Y, 5M, 5C, and 5K), charging devices 6 (6Y, 6M, 6C, and 6K), exposure devices 7 (7Y, 7M, 7C, and 7K), developing devices 8 (8Y, 8M, 8C, and 8K), a transfer device 9 (an example of a transport device), and a fixing device 10.

Photosensitive layers are formed on surfaces of the photoconductor drums 5. Each of the photoconductor drums 5 is driven by a driving unit (not illustrated) and rotates about an axis thereof. The charging devices 6Y, 6M, 6C, and 6K charge the surfaces of the corresponding photoconductor drums 5Y, 5M, 5C, and 5K to a predetermined potential. The exposure devices 7Y, 7M, 7C, and 7K expose the surfaces of the corresponding photoconductor drums 5Y, 5M, 5C, and 5K, which have been charged, to light on the basis of image data that is output from the image processing unit 2 in such a manner as to form electrostatic latent images. The developing devices 8Y, 8M, 8C, and 8K develop the corresponding electrostatic latent images, which have been formed on the photoconductor drums 5Y, 5M, 5C, and 5K, by using toners of yellow, magenta, cyan, and black in such a manner as to form toner images. Each of the photoconductor drums 5 is an example of an image carrier that holds a toner image. The charging devices 6, the exposure devices 7, and the developing devices 8 are examples of image forming units.

The transfer device 9 transfers the toner images, which have been formed on the photoconductor drums 5, onto one of the recording media that is transported from the sheet feed unit 3. Details of the transfer device 9 will be described later. The fixing device 10 includes a fixing roller 101 and a pressure roller 102. In the fixing device 10, the fixing roller 101 and the pressure roller 102 apply heat and pressure to the toner images on the recording medium, so that the toner images are fixed onto the recording medium.

In the following description, a three-dimensional rectangular coordinate system is defined for the sake of explanation. In this coordinate system, an x axis represents an axial direction of the photoconductor drums 5 (a direction perpendicular to FIG. 1), a y axis represents a direction from the photoconductor drum 5Y toward the photoconductor drum 5K, and a z axis represents a height direction of the image forming apparatus 100. Note that a positive y-axis direction will be hereinafter referred to as a reference direction.

Figure 2:
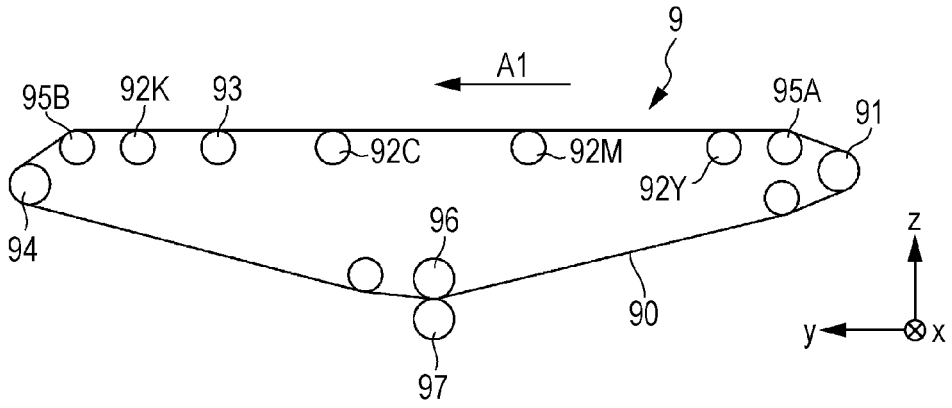
FIG. 2 is a diagram illustrating a schematic internal configuration of a transfer device.

FIG. 2 is a diagram illustrating a schematic internal configuration of the transfer device 9. The transfer device 9 includes an intermediate transfer belt 90, a drive roller 91, first transfer rollers 92 (92Y, 92M, 92C, and 92K), a support roller 93, a steering roller 94, stretching rollers 95A and 95B, a backup roller 96, and a second transfer roller 97. Rotary shafts of the various rollers, which are included in the transfer device 9, are supported by frames 9A and 9B of the transfer device 9 (see FIG. 3).

The intermediate transfer belt 90 is a member having the form of an endless belt. The drive roller 91 is a member that drives the intermediate transfer belt 90 so that the intermediate transfer belt 90 rotates. The drive roller 91 drives the intermediate transfer belt 90 so that the intermediate transfer belt 90 rotates in the direction of arrow A1 in FIG. 2. The first transfer rollers 92Y, 92M, 92C, and 92K are members that transfer (transfer in a first transfer process) toner images that have been formed on the photoconductor drums 5Y, 5M, 5C, and 5K onto the intermediate transfer belt 90. A transfer bias is applied to the first transfer rollers 92Y, 92M, 92C, and 92K by a power source (not illustrated), and potential differences are generated between the first transfer rollers 92Y, 92M, 92C, and 92K and the corresponding photoconductor drums 5Y, 5M, 5C, and 5K. The first transfer rollers 92Y, 92M, 92C, and 92K press the intermediate transfer belt 90 from the inner side of the intermediate transfer belt 90 toward the photoconductor drums 5Y, 5M, 5C, and 5K in a state where the potential differences have been generated, so that the toner images are transferred onto the intermediate transfer belt 90. In FIG. 2, the first transfer rollers 92Y, 92M, 92C, and 92K transfer the toner images onto the intermediate transfer belt 90 at positions further downstream than the drive roller 91 and further upstream than the steering roller 94 in a direction in which the intermediate transfer belt 90 moves (hereinafter referred to as a movement direction). The toner images that have been transferred to the intermediate transfer belt 90 are transported to the second transfer roller 97. The support roller 93 is a member that supports the intermediate transfer belt 90. The support roller 93 supports the intermediate transfer belt 90 at a position between the first transfer rollers 92C and the first transfer rollers 92K.

The steering roller 94 (an example of a first stretching roller) is a member that stretches the intermediate transfer belt 90 and adjusts the position of the intermediate transfer belt 90. The steering roller 94 is controlled by a control mechanism (not illustrated) in such a manner that one side of the rotary shaft of the steering roller 94 is displaceable, and the steering roller 94 adjusts the position of the intermediate transfer belt 90 in the x-axis direction. The stretching roller 95A (an example of a second stretching roller) and the stretching roller 95B are members that stretch the intermediate transfer belt 90 at positions between the drive roller 91 and the steering roller 94 and on the side on which the first transfer rollers 92 are in contact with the intermediate transfer belt 90. In FIG. 2, the stretching roller 95A stretches the intermediate transfer belt 90 at a position further downstream than the drive roller 91 and further upstream than the first transfer rollers 92Y in the movement direction of the intermediate transfer belt 90. The stretching roller 95B stretches the intermediate transfer belt 90 at a position further downstream than the first transfer rollers 92K and further upstream than the steering roller 94 in the movement direction of the intermediate transfer belt 90.

The backup roller 96 is a member that stretches the intermediate transfer belt 90. The backup roller 96 opposes the second transfer roller 97 with the intermediate transfer belt 90 interposed therebetween. The second transfer roller 97 transfers (transfers in a second transfer process) the toner images, which have been transferred to the intermediate transfer belt 90, onto one of the recording media that has been transported from the sheet feed unit 3. A transfer bias is applied to the second transfer roller 97 by a power source (not illustrated), and a potential difference is generated between the second transfer roller 97 and the backup roller 96. The second transfer roller 97 transfers toner images onto the recording medium by pressing the recording medium toward the intermediate transfer belt 90 in a state where the potential difference has been generated.

Figure 3:
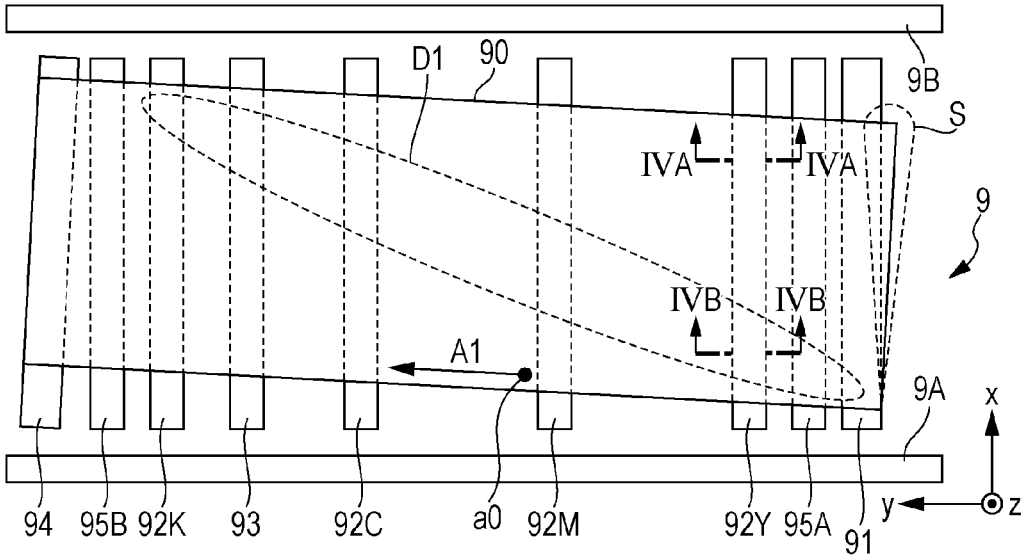
FIG. 3 is a general view of the transfer device as seen from the side on which photoconductor drums are disposed.

FIG. 3 is a general view of the transfer device 9 as seen from the side on which the photoconductor drums 5 are disposed. In the case where the rotary shafts (not illustrated) of the various rollers, which are included in the transfer device 9, are not aligned with a reference axis, the intermediate transfer belt 90 may sometimes be skewed. Here, the term "skew" refers to a phenomenon in which the angle formed by the movement direction of the intermediate transfer belt 90 and the reference direction (the positive y-axis direction) deviates from a predetermined angle (the difference between the angle and the predetermined angle exceeds a predetermined threshold) as seen from the side on which the photoconductor drums 5 are disposed. Note that although the movement direction of the intermediate transfer belt 90 may sometimes differ depending on a position on the intermediate transfer belt 90, here, in the case where there is a point that moves in a direction that is displaced from the reference direction on the intermediate transfer belt 90, it may be said that the intermediate transfer belt 90 is skewed. In FIG. 3, a point a0 on the intermediate transfer belt 90 moves in the direction of arrow A1 that is displaced from the reference direction, and the intermediate transfer belt 90 is skewed. When the intermediate transfer belt 90 is skewed, a gap S is generated between the intermediate transfer belt 90 and the drive roller 91 on one side of the drive roller 91. When the gap S is generated, a tension that is applied in the movement direction of the intermediate transfer belt 90 (hereinafter simply referred to as a tension applied to the intermediate transfer belt 90) is non-uniform in a width direction of the intermediate transfer belt 90. For example, in the example illustrated in FIG. 3, since the tension applied to the intermediate transfer belt 90 is non-uniform, wrinkles are generated in a region D1 in a surface of the intermediate transfer belt 90.

Figure 4A:
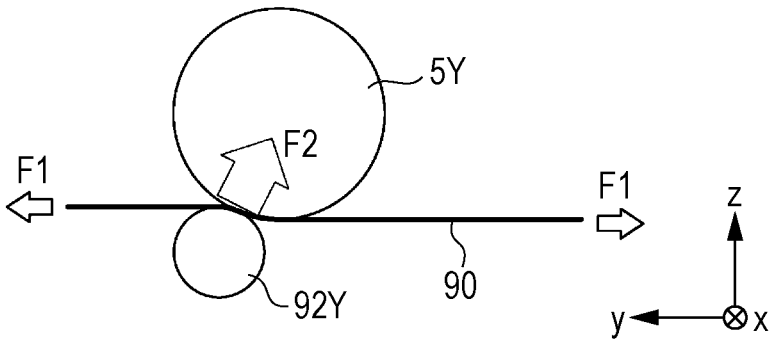
FIGS. 4A and 4B are diagrams illustrating a positional relationship between one of first transfer rollers and one of the photoconductor drums.
Figure 4B:
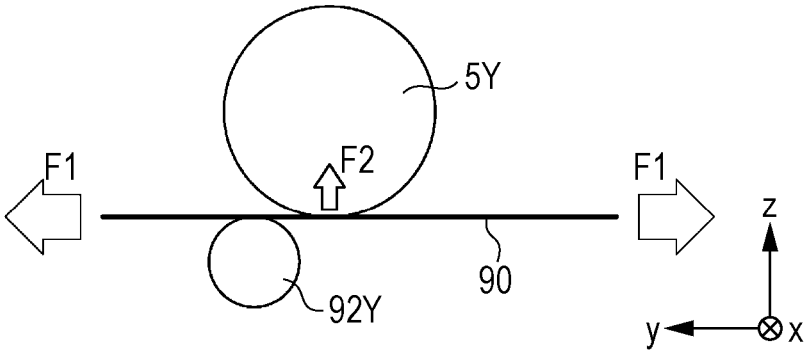

FIGS. 4A and 4B are diagrams illustrating a positional relationship between the first transfer roller 92Y and the photoconductor drum 5Y. FIGS. 4A and 4B are schematic diagrams illustrating cross-sectional views of the first transfer roller 92Y and the photoconductor drum 5Y at different positions in the x-axis direction. Note that a state where the first transfer rollers 92M, 92C, and 92K are pressing the intermediate transfer belt 90 against the photoconductor drums 5M, 5C, and 5K is similar to the state that is illustrated in FIGS. 4A and 4B. FIG. 4A is a schematic diagram (a cross-sectional view taken along line IVA-IVA of FIG. 3) of a portion in which a tension F1 that is applied in the movement direction of the intermediate transfer belt 90 is small, and FIG. 4B is a schematic diagram (a cross-sectional view taken along line IVB-IVB of FIG. 3) of a portion in which the tension F1, which is applied in the movement direction of the intermediate transfer belt 90, is large.

As illustrated in FIG. 4A, in the portion in which the tension F1, which is applied to the intermediate transfer belt 90, is small, a pressing force that is applied by the first transfer roller 92Y to the intermediate transfer belt 90 against the photoconductor drum 5Y is less likely to be reduced, and thus, a pressure F2 generated by contact between the photoconductor drum 5Y and the intermediate transfer belt 90 is large. Therefore, a current easily flows between the first transfer roller 92Y and the photoconductor drum 5Y, and toner particles that have moved to the surface of the intermediate transfer belt 90 from the surface of the photoconductor drum 5Y easily move onto the surface of the photoconductor drum 5Y again. As a result, in the portion in which the tension F1, which is applied to the intermediate transfer belt 90, is small, the density of toner images that are to be transferred in the first transfer process onto the intermediate transfer belt 90 is low.

As illustrated in FIG. 4B, in the portion in which the tension F1, which is applied to the intermediate transfer belt 90, is large, a pressing force that is applied by the first transfer roller 92Y to the intermediate transfer belt 90 against the photoconductor drum 5Y is reduced, and thus, the pressure F2 generated by contact between the photoconductor drum 5Y and the intermediate transfer belt 90 is small. Therefore, a current is less likely to flow between the first transfer roller 92Y and the photoconductor drum 5Y, and toner particles that have moved to the surface of the intermediate transfer belt 90 from the surface of the photoconductor drum 5Y are less likely to move onto the surface of the photoconductor drum 5Y again. As a result, in the portion in which the tension F1, which is applied to the intermediate transfer belt 90, is large, the density of toner images that are to be transferred in the first transfer process onto the intermediate transfer belt 90 is high.

As described above, in the case where the intermediate transfer belt 90 is skewed, and where the tension F1, which is applied to the intermediate transfer belt 90, becomes non-uniform in the width direction of the intermediate transfer belt 90, unevenness in the density of the toner images, which are to be transferred in the first transfer process onto the intermediate transfer belt 90, in the x-axis direction is generated. The transfer device 9 according to the exemplary embodiment of the present invention prevents the intermediate transfer belt 90 from being skewed by changing the direction of a rotary shaft al of the stretching roller 95A.

Figure 5:
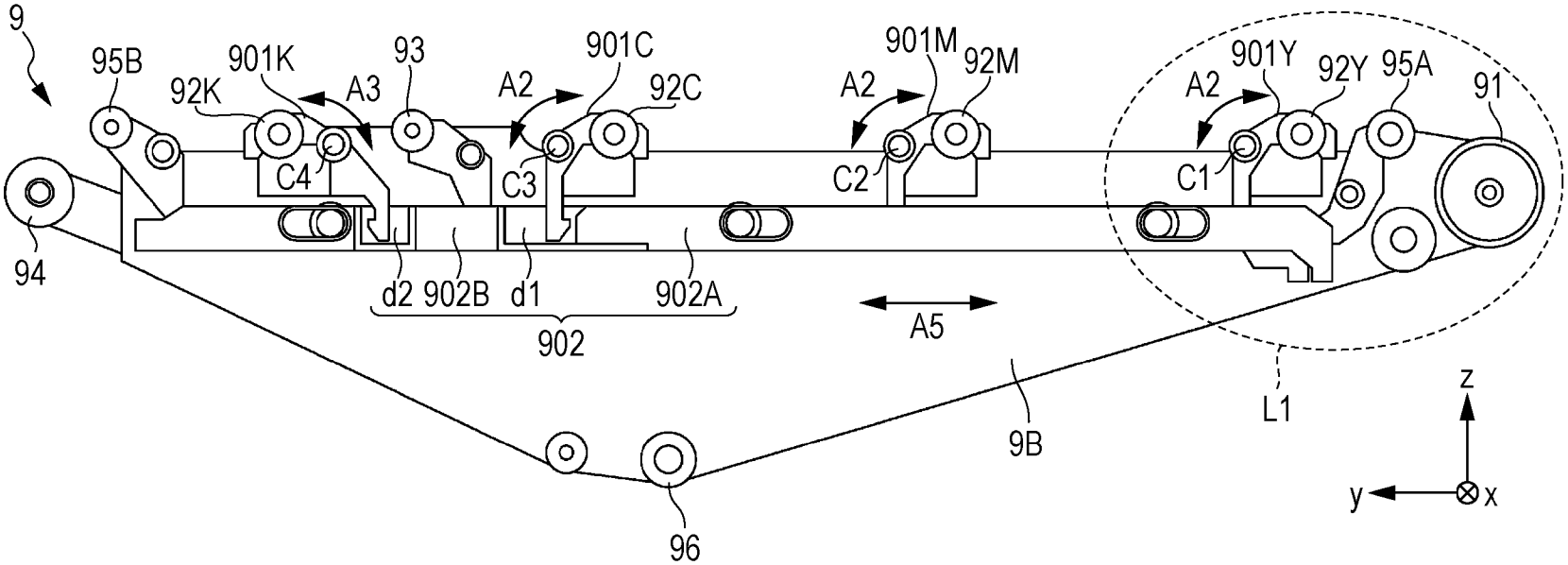
FIG. 5 is a diagram illustrating the internal configuration of the transfer device.

FIG. 5 is a diagram illustrating the internal configuration of the transfer device 9 when the frame 9B is viewed from the side on which the frame 9A is disposed. Note that the internal configuration of the transfer device 9 when the frame 9A is viewed from the side on which the frame 9B is disposed is similar to that illustrated in FIG. 5 (is obtained by horizontally reversing the internal configuration illustrated in FIG. 5). In order to prevent wear of the photoconductor drums 5, the transfer device 9 brings the intermediate transfer belt 90 into contact with the photoconductor drums 5 when an image is formed and separates the intermediate transfer belt 90 from the photoconductor drums 5 when an image is not formed. The transfer device 9 moves the first transfer rollers 92 in such a manner as to make transition between a state where the intermediate transfer belt 90 is pressed against the photoconductor drums 5 and a state where the intermediate transfer belt 90 is not pressed against the photoconductor drums 5. The transfer device 9 includes arm members 901 (901Y, 901M, 901C, and 901K) and a sliding mechanism 902 as a moving mechanism that is used for moving the first transfer rollers 92. The arm members 901Y, 901M, and 901C are members that support the first transfer rollers 92Y, 92M, and 92C on one side of the rotary shafts of the first transfer rollers 92 and rotate in the direction of arrow A2 while a point C1, a point C2, and a point C3 serve as fulcrums. The arm member 901K is a member that supports the first transfer roller 92K on one side of the rotary shaft of the first transfer roller 92K and rotates in the direction of arrow A3 while a point C4 serves as a fulcrum.

The sliding mechanism 902 is a mechanism that is used for causing the arm members 901 to rotate. The sliding mechanism 902 includes two members (a slide member 902A and a slide member 902B) that extend from the side on which the drive roller 91 is disposed toward the side on which the steering roller 94 is disposed. The slide member 902A is a member that is disposed on the side on which the drive roller 91 is disposed and has grooves (not illustrated) into which one ends (ends that do not support the first transfer roller 92Y and the first transfer roller 92M) of the arm members 901Y and 901M are fitted. An end of the slide member 902A on the side on which the steering roller 94 is disposed makes contact with an end (an end that does not support the first transfer roller 92C) of the arm member 901C. The slide member 902A is driven by a drive mechanism (not illustrated) so as to slide in the direction of arrow A5 and causes the arm members 901Y, 901M, and 901C to rotate in the direction of arrow A2. The slide member 902B is a member that is disposed on the side on which the steering roller 94 is disposed and has a groove d1 into which one side portion of the arm member 901C is fitted and a groove d2 into which one end (an end that does not support the first transfer roller 92K) of the arm member 901K is fitted. The slide member 902B is driven independently from the slide member 902A by a drive mechanism (not illustrated) so as to slide in the direction of arrow A5 and causes the arm member 901K to rotate in the direction of arrow A3.

Figure 6A:
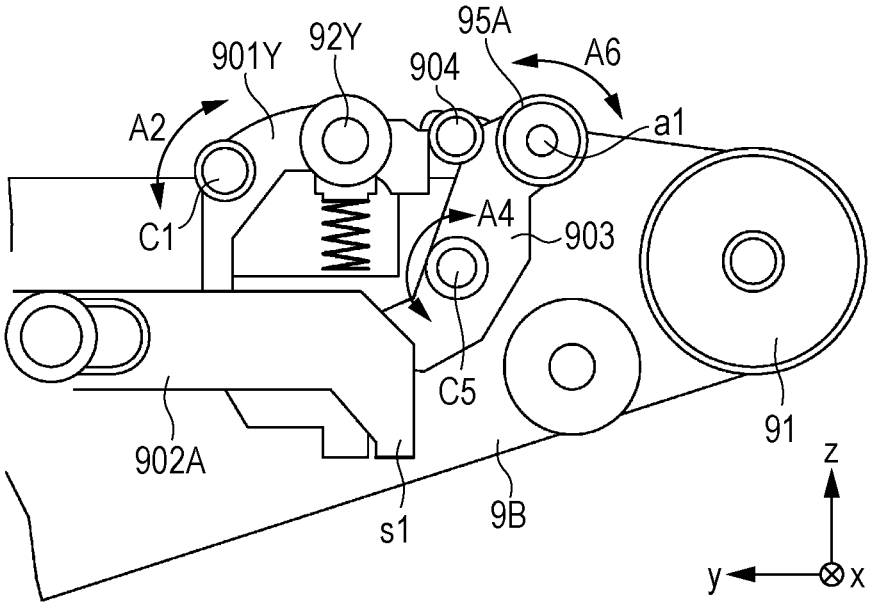
FIGS. 6A and 6B are diagrams illustrating a mechanism that changes the direction of a rotary shaft of a stretching roller.
Figure 6B:
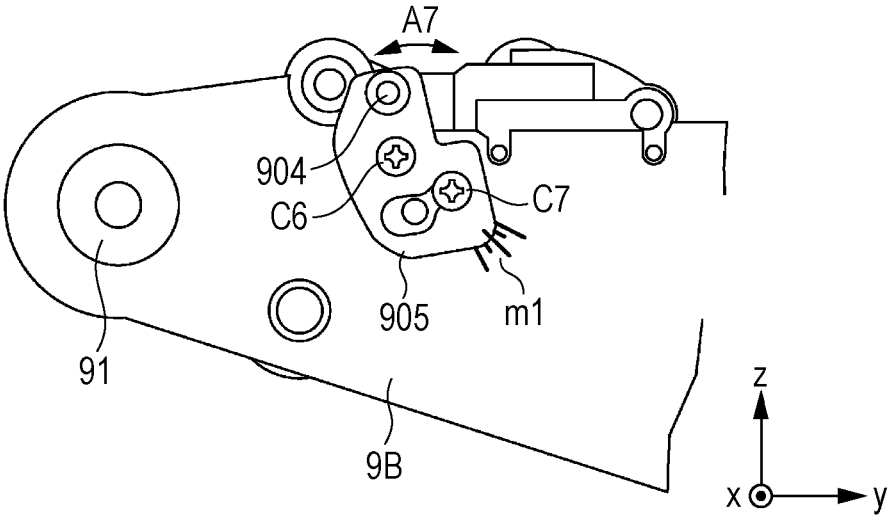

FIGS. 6A and 6B are diagrams illustrating a mechanism that changes the direction of the rotary shaft al of the stretching roller 95A. FIG. 6A is an enlarged view of a portion that is defined by a dashed line L1 in FIG. 5 FIG. 6B is a diagram illustrating the portion illustrated in FIG. 6A as seen from an area outside the transfer device 9 (i.e., the side opposite to the side illustrated in FIG. 6A). In this example, the transfer device 9 changes the direction of the rotary shaft al of the stretching roller 95A by adjusting the position of an end of the stretching roller 95A on the side on which the frame 9B is disposed. The transfer device 9 includes an adjusting mechanism that is used for changing the direction of the rotary shaft al of the stretching roller 95A and adjusting the angle formed by the movement direction of the intermediate transfer belt 90 and the reference direction. The adjusting mechanism includes arm members 903 (examples of support members), a locating member 904, and an adjusting member 905.

The arm members 903 support the stretching roller 95A on one side of the rotary shaft al of the stretching roller 95A and rotates in the direction of arrow A4 while a point C5 serves as a fulcrum. The direction in which the arm members 903 rotate contains a component in a direction normal to the intermediate transfer belt 90 in an area in which the stretching roller 95A stretches the intermediate transfer belt 90 (a component in the z-axis direction in FIGS. 6A and 6B) and a component in the direction in which the first transfer rollers 92 rotate as seen from the side on which the photoconductor drums 5 are disposed (a component in the y-axis direction in FIGS. 6A and 6B). When the arm members 903 rotate, the stretching roller 95A moves in the direction of arrow A6. The slide member 902A has a protruding portion s1 that makes contact with one end (an end that does not support the stretching roller 95A) of the arm members 903. The slide member 902A slides in the direction of arrow A5, so that the arm members 903 rotate in the direction of arrow A4. The slide member 902A causes, synchronously with the arm members 901Y, 901M, and 901C, the arm members 903 to rotate.

The locating member 904 extends from the side on which one of the ends of the stretching roller 95A is present toward the side on which the other one of the ends of the stretching roller 95A is present (i.e., from the frame 9A toward frame 9B) and is a member that determines the positions of the arm members 903. The locating member 904 comes into contact with the arm members 903 when the arm members 903 rotate and determines the positions of the arm members 903. An end of the locating member 904 on the side on which the frame 9B is disposed is supported by the adjusting member 905 (FIG. 6B), and an end (not illustrated) of the locating member 904 on the side on which the frame 9A is disposed is supported by the frame 9A so as not to move.

The adjusting member 905 is a member that adjusts the position of the end of the locating member 904 on the side on which the frame 9B is disposed. Note that the adjusting member 905 is not disposed on the side on which the frame 9A is disposed. The adjusting member 905 is screwed onto the frame 9B at a point C6 and a point C7. The adjusting member 905 moves the position of the end of the locating member 904 on the side on which the frame 9B is disposed in the direction of arrow A7 by rotating while the point C6 serves as a fulcrum and adjusts the position of the end of the locating member 904 on the side on which the frame 9B is disposed. The direction in which the end of the locating member 904 on the side on which the frame 9B is disposed is moved contains a component in the z-axis direction and a component in the y-axis direction.

For example, an operator who performs adjustment of skewing of the intermediate transfer belt 90 manually causes, while checking a scale m1, the adjusting member 905 to rotate. The scale m1 is formed on the frame 9B in such a manner as to allow the operator to recognize a rotation of the adjusting member 905. As described above, the end (not illustrated) of the locating member 904 on the side on which the frame 9A is disposed is supported by the frame 9A so as not to move. Therefore, when the end of the locating member 904 on the side on which the frame 9B is disposed is moved as a result of the adjusting member 905 being rotated, an axial direction of the locating member 904 changes. When the axial direction of the locating member 904 changes, the locating member 904 makes contact with the arm members 903 at a position on the side on which the frame 9A is disposed and a different position on the side on which the frame 9B is disposed on a yz plane, and a difference occurs between a rotation amount of one of the arm members 903 (not illustrated) on the side on which the frame 9A is disposed and a rotation amount of the other one of the arm members 903 on the side on which the frame 9B is disposed. The difference in rotation amount causes a difference between an amount of movement of the stretching roller 95A in the direction of arrow A6 caused by the arm member 903 on the side on which the frame 9A is disposed and an amount of movement of the stretching roller 95A in the direction of arrow A6 caused by the arm member 903 on the side on which the frame 9B is disposed, and the direction of the rotary shaft al of the stretching roller 95A changes. In other words, the relative positions of an end of the rotary shaft al of the stretching roller 95A on the side on which the frame 9A is disposed and an end of the rotary shaft al of the stretching roller 95A on the side on which the frame 9B is disposed change. As a result, a direction in which the intermediate transfer belt 90 is transported by the stretching roller 95A changes, and the intermediate transfer belt 90 is prevented from being skewed.

An operator measures, for example, the angle formed by the movement direction of the intermediate transfer belt 90 and the reference direction, uniformity of a tension that is applied to the intermediate transfer belt 90, a degree of unevenness in the density of toner images, which are to be transferred in the first transfer process onto the intermediate transfer belt 90, that is generated in the x-axis direction, or the like by using a sensor (not illustrated) and causes the adjusting member 905 to rotate by an amount that corresponds to measurement results. As a specific example, in the case where it is measured that the intermediate transfer belt 90 is skewed to the side on which the frame 9B is disposed, an operator causes the adjusting member 905 to rotate in such a manner that the position at which the arm member 903 on the side on which the frame 9B is disposed supports the rotary shaft al of the stretching roller 95A is higher than the position at which the arm member 903 on the side on which the frame 9A is disposed supports the rotary shaft al of the stretching roller 95A. Alternatively, in the case where it is measured that the intermediate transfer belt 90 is skewed to the side on which the frame 9A is disposed, the operator causes the adjusting member 905 to rotate in such a manner that the position at which the arm member 903 on the side on which the frame 9B is disposed supports the rotary shaft al of the stretching roller 95A is lower than the position at which the arm member 903 on the side on which the frame 9A is disposed supports the rotary shaft al of the stretching roller 95A.

(Modifications)

The present invention is not limited to the above-described embodiment, and various modifications may be made. Some modifications will be described below. Two or more modifications among the following modifications may be combined and employed.

(1) The adjusting member 905 is not limited to being manually made to rotate. The adjusting mechanism of the transfer device 9 may include a drive mechanism that is used for causing the adjusting member 905 to rotate. In this case, the drive mechanism includes, for example, a cam that makes contact with the adjusting member 905 and a motor or an actuator that supplies power to the adjusting member 905 via the cam. In addition, in this case, the adjusting mechanism of the transfer device 9 includes a measuring unit that measures the angle formed by the movement direction of the intermediate transfer belt 90 and the reference direction, and the drive mechanism may cause the adjusting member 905 to rotate in accordance with an angle that is measured by the measuring unit. Alternatively, the uniformity of the tension, which is applied to the intermediate transfer belt 90, the degree of the unevenness in the density of the toner images, which are to be transferred in the first transfer process onto the intermediate transfer belt 90, that is generated in the x-axis direction, or the like may be measured by a sensor, and the drive mechanism may cause the adjusting member 905 to rotate by an amount that corresponds to measurement results. Note that the drive mechanism may cause the adjusting member 905 to rotate in accordance with measurement results that are obtained by multiple sensors that measure different physical quantities such as the angle formed by the movement direction of the intermediate transfer belt 90 and the reference direction, the uniformity of the tension, which is applied to the intermediate transfer belt 90, the degree of the unevenness in the density of the toner images, which are to be transferred in the first transfer process onto the intermediate transfer belt 90, that is generated in the x-axis direction, and the like.

Figure 7A:
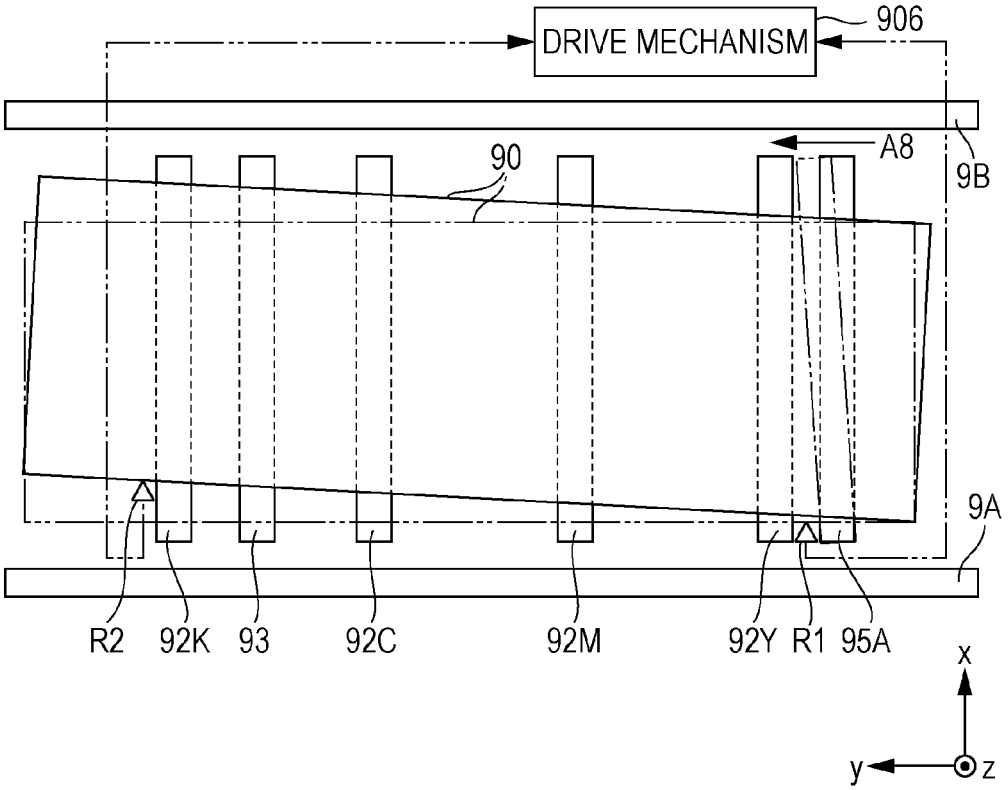
FIGS. 7A and 7B are schematic diagrams of a measuring unit.
Figure 7B:
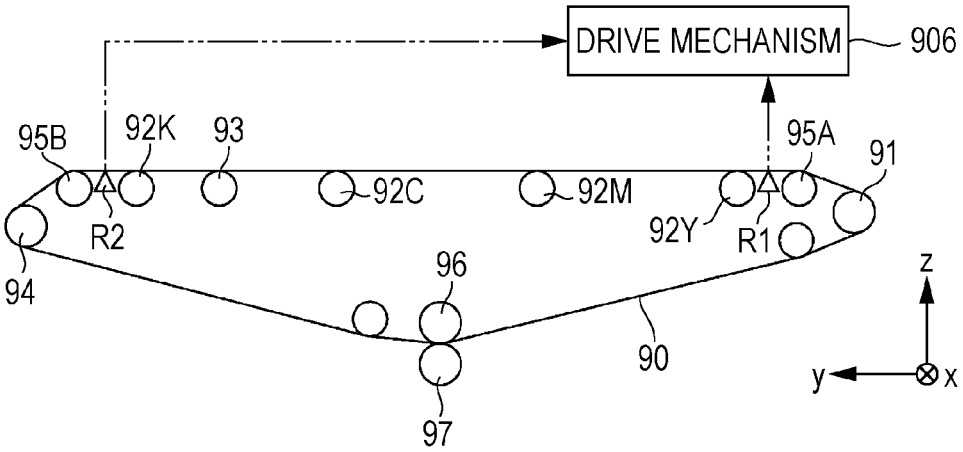

FIGS. 7A and 7B are schematic diagrams of a measuring unit. In FIGS. 7A and 7B, the measuring unit includes a sensor R1 (an example of a first sensor) and a sensor R2 (an example of a second sensor). FIG. 7A illustrates the positions of the sensors R1 and R2 when the transfer device 9 is viewed from the side on which the photoconductor drums 5 are disposed. FIG. 7B illustrates the positions of the sensors R1 and R2 when the transfer device 9 is viewed from one side in the width direction of the intermediate transfer belt 90. Each of the sensors R1 and R2 is an edge sensor that senses the position of an edge of the intermediate transfer belt 90 on the side on which the frame 9A is disposed in the width direction of the intermediate transfer belt 90. The sensor R1 (an example of the first sensor) senses the position of the edge of the intermediate transfer belt 90 at a position further downstream than the stretching roller 95A in the movement direction of the intermediate transfer belt 90. The sensor R2 (an example of the second sensor) senses the position of the edge of the intermediate transfer belt 90 at a position further upstream than the stretching roller 95B in the movement direction of the intermediate transfer belt 90. Note that each of the sensor R1 and the sensor R2 may sense the position of an edge of the intermediate transfer belt 90 on the side on which the frame 9B is disposed in the width direction of the intermediate transfer belt 90. In FIGS. 7A and 7B, the measuring unit measures the angle formed by the movement direction of the intermediate transfer belt 90 and the reference direction by using a difference between the position of the edge of the intermediate transfer belt 90 that is sensed by the sensor R1 and the position of the edge of the intermediate transfer belt 90 that is sensed by the sensor R2. A drive mechanism 906 causes the adjusting member 905 to rotate in accordance with an angle that is measured by the measuring unit. In FIGS. 7A and 7B, the transfer device 9 prevents the intermediate transfer belt 90 from being skewed by inclining an end of the rotary shaft al (not illustrated) of the stretching roller 95A on the side on which the frame 9B is disposed in the direction of arrow A8. The intermediate transfer belt 90 that is indicated by a two-dot chain line is the intermediate transfer belt 90 that is prevented from being skewed.

(2) The transfer device 9 may change the direction of the rotary shaft al of the stretching roller 95A by adjusting the position of the end of the stretching roller 95A on the side on which the frame 9A is disposed. In this case, the adjusting member 905 is disposed on the side on which the frame 9A is disposed, an end of the locating member 904 on the side on which the frame 9A is disposed is supported by the adjusting member 905, and the end of the locating member 904 on the side on which the frame 9B is disposed is supported by the frame 9B so as not to move.

(3) A mechanism in which the transfer device 9 changes the direction of the rotary shaft al of the stretching roller 95A is not limited to the above-described mechanism. For example, the transfer device 9 may change the direction of the rotary shaft al of the stretching roller 95A by adjusting the positions of the ends of the stretching roller 95A. In this case, the adjusting member 905 is disposed on both the sides on which the frame 9A and the frame 9B are disposed, and the ends of the locating member 904 may be supported by the adjusting members 905.

(4) The second stretching roller is not limited to the stretching roller 95A. The stretching roller 95B may be the second stretching roller. In this case, a mechanism that is similar to the above-described adjusting mechanism and that is used for changing the direction of the rotary shaft of the stretching roller 95B is disposed further downstream than the first transfer roller 92K in the movement direction of the intermediate transfer belt 90. In addition, the transfer device 9 may prevent the intermediate transfer belt 90 from being skewed by individually changing the direction of the rotary shaft al of the stretching roller 95A and the direction of the rotary shaft of the stretching roller 95B. In this case, the transfer device 9 includes an adjusting mechanism that is used for changing the direction of the rotary shaft al of the stretching roller 95A and an adjusting mechanism that is used for changing the direction of the rotary shaft of the stretching roller 95B.

(5) The adjusting mechanism is not limited to the above-described mechanism. The adjusting mechanism may be any mechanism as long as the mechanism prevents the intermediate transfer belt 90 from being skewed by changing the direction of a rotary shaft of the second stretching roller. For example, the adjusting member 905 may adjust the position of the end of the locating member 904 by sliding on the frame 9B in the y-axis direction or the z-axis direction. The arm members 903 need not rotate. The arm members 903 may be members that move in the y-axis direction or the z-axis direction.

(6) The reference direction is not limited to the positive y-axis direction. The reference direction may be any one of directions on an xy plane.

(7) The image forming apparatus to which the present invention is applied is not limited to an apparatus that performs color printing. The present invention may be applied to an image forming apparatus that performs only monochrome printing.

(8) The internal configuration of the transfer device 9 is not limited to the above-described configuration. For example, the drive roller 91 may be disposed further downstream than the first transfer rollers 92 in the movement direction of the intermediate transfer belt 90, and the steering roller 94 may be disposed further upstream than the first transfer rollers 92 in the movement direction of the intermediate transfer belt 90. Alternatively, the first stretching roller is not limited to the steering roller 94. The first stretching roller may be any roller as long as the roller stretches the intermediate transfer belt 90.

(9) The configurations of the units of the image forming apparatus 100 are not limited to the above-described configurations. For example, a fixing device that fixes a toner image that is formed on a recording medium onto the recording medium by radiating a laser beam onto the toner image may be used instead of the above-described fixing device 10.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport device comprising:

a driving roller configured to drive an endless belt so that the belt rotates;

a transfer roller configured to press the belt from an inner side of the belt toward an image carrier carrying a toner image, wherein the transfer roller is configured to transfer the toner image onto the belt;

a first stretching roller configured to stretch the belt;

a second stretching roller configured to stretch the belt, wherein the second stretching roller is disposed at a position between the driving roller and the first stretching roller, and wherein the second stretching roller is disposed on a side on which the transfer roller is configured to contact the belt; and an adjusting mechanism configured to adjust a direction of a rotary shaft of the second stretching roller, wherein the transfer roller is configured to transfer the toner image at a position further downstream than the driving roller and further upstream than the first stretching roller in a movement direction of the belt, wherein the second stretching roller is configured to stretch the belt at a position further downstream than the driving roller and further upstream than the transfer roller in the movement direction of the belt, wherein the driving roller, the second stretching roller, the transfer roller and the first stretching roller are arranged in order in the movement direction of the belt, and wherein both the second stretching roller and the driving roller are, when viewed along a rotational axis of the transfer roller, disposed on a same side of a normal line extending through the rotational axis of the transfer roller and extending normal to an outer side of the belt.

2. The transport device according to claim 1, wherein the adjusting mechanism includes:

a support member configured to support the second stretching roller on one side of the rotary shaft and configured to move in a direction normal to the belt in an area in which the second stretching roller stretches the belt;

a locating member that extends from a side on which a first end of the second stretching roller is present toward a side on which a second end of the second stretching roller is present, wherein the locating member is configured to determine a position of the support member by making contact with the support member; and an adjusting member configured to adjust a position of one end of the locating member.

3. The transport device according to claim 1, wherein the adjusting mechanism includes:

a support member configured to support the second stretching roller on one side of the rotary shaft and configured to move in a direction in which the transfer roller rotates as seen from a side on which the image carrier is disposed;

a locating member that extends from a side on which a first end of the second stretching roller is present toward a side on which a second end of the second stretching roller is present, wherein the locating member is configured to determine a position of the support member by making contact with the support member; and an adjusting member configured to adjust a position of one end of the locating member.

4. The transport device according to claim 2, wherein the adjusting member is configured to move the position of the one end of the locating member in the direction normal to the belt.

5. The transport device according to claim 3, wherein the adjusting member is configured to move the position of the one end of the locating member in the direction in which the transfer roller rotates as seen from the side on which the image carrier is disposed.

6. The transport device according to claim 2, wherein the adjusting mechanism includes:

a measuring unit configured to measure an angle formed by a movement direction of the belt and a predetermined reference direction; and a drive mechanism configured to drive the adjusting member in accordance with the angle that is measured by the measuring unit.

7. The transport device according to claim 6, wherein the measuring unit includes:

a first sensor configured to sense a position of the belt at a position further upstream than the transfer roller in the movement direction of the belt; and a second sensor configured to sense a position of the belt at a position further downstream than the transfer roller, and wherein the measuring unit is configured to measure the angle formed by the movement direction of the belt and the reference direction by using a difference between a position that is sensed by the first sensor and a position that is sensed by the second sensor.

8. The transport device according to claim 2, further comprising:

a drive mechanism configured to drive the adjusting member in accordance with variation in density of the toner image that has been transferred to the belt in a direction parallel to a rotary shaft of the transfer roller.

9. An image forming apparatus comprising:

an image forming unit configured to form a toner image on an image carrier;

a driving roller configured to drive an endless belt so that the belt rotates;

a transfer roller configured to press the belt from an inner side of the belt toward the image carrier carrying the toner image, wherein the transfer roller is configured to transfer the toner image onto the belt;

a first stretching roller configured to stretch the belt;

a second stretching roller configured to stretch the belt, wherein the second stretching roller is disposed at a position between the driving roller and the first stretching roller, wherein the second stretching roller is disposed on a side on which the transfer roller is configured to contact the belt; and an adjusting mechanism configured to adjust a direction of a rotary shaft of the second stretching roller, wherein the transfer roller is configured to transfer the toner image at a position further downstream than the driving roller and further upstream than the first stretching roller in a movement direction of the belt, wherein the second stretching roller is configured to stretch the belt at a position further downstream than the driving roller and further upstream than the transfer roller in the movement direction of the belt, wherein the driving roller, the second stretching roller, the transfer roller and the first stretching roller are arranged in order in the movement direction of the belt, and wherein both the second stretching roller and the driving roller are, when viewed along a rotational axis of the transfer roller, disposed on a same side of a normal line extending through the rotational axis of the transfer roller and extending normal to an outer side of the belt.

10. The transport device according to claim 1, wherein the adjusting mechanism is configured to adjust the direction of the rotary shaft of the second stretching roller to thereby reduce skew of the belt.

11. The transport device according to claim 1, wherein the first stretching roller is a steering roller.

12. The transport device according to claim 11, wherein a rotary shaft of the first stretching roller is displaceable to thereby steer the belt.

* * * * *